US006375022B1

(12) United States Patent
Zurcher et al.

(10) Patent No.: US 6,375,022 B1
(45) Date of Patent: Apr. 23, 2002

(54) RESEALABLE CLOSURE FOR CONTAINERS

(75) Inventors: Robert Zurcher, Little Falls, NJ (US); C. Mark Newby, Tuxedo, NY (US)

(73) Assignee: Becton, Dickinson and Company, Franklin Lakes, NJ (US)

( * ) Notice: Subject to any disclaimer, the term of this patent is extended or adjusted under 35 U.S.C. 154(b) by 0 days.

(21) Appl. No.: 09/607,905

(22) Filed: Jun. 30, 2000

(51) Int. Cl.[7] ..... B65D 39/00

(52) U.S. Cl. ..... 215/247; 215/232; 215/320; 215/350; 215/354; 604/256; 604/415; 604/905

(58) Field of Search ..... 215/247, 232, 215/317, 320, 321, 341, 347, 350, 354; 220/255, 256, 359.1; 604/256, 246, 905, 415, 167.02, 167.06, 164.02, 411–414

(56) References Cited

U.S. PATENT DOCUMENTS

| | | | | | |
|---|---|---|---|---|---|
| 4,573,582 A | * | 3/1986 | Kusz | 215/232 X |
| 4,811,856 A | * | 3/1989 | Fischman | 215/232 X |
| 4,815,618 A | * | 3/1989 | Gach | 215/232 |
| 5,275,299 A | * | 1/1994 | Konrad et al. | 215/341 |
| 5,522,518 A | * | 6/1996 | Konrad et al. | 215/DIG. 3 X |
| 5,632,396 A | * | 5/1997 | Burns | 215/247 |
| 5,779,074 A | * | 7/1998 | Burns | 215/247 |
| 6,145,688 A | * | 11/2000 | Smith | 220/847 X |
| 6,170,693 B1 | * | 1/2001 | Goto | 220/256 X |

FOREIGN PATENT DOCUMENTS

| | | | |
|---|---|---|---|
| EP | 454493 | * 10/1991 | 215/364 |
| IT | 572197 | * 8/1958 | 215/320 |

* cited by examiner

*Primary Examiner*—Lee Young
*Assistant Examiner*—Robin A Hylton
(74) *Attorney, Agent, or Firm*—Alan W. Fiedler; Nanette S. Thomas

(57) ABSTRACT

A resealable barrier closure is provided for a container with an open top and an annular snap ring below the open top. The closure includes a shell having an outer skirt dimensioned to telescope over the open top of the container. The outer skirt has a snap ring for engaging the snap ring on the container. The shell further includes an inner skirt to telescope into the open top of the container. An elastomeric diaphragm is sealingly engaged in the inner skirt. A barrier cup extends across the bottom face of the diaphragm and telescopes upwardly over the inner skirt. The barrier cup initially is sealed hermetically to the container and to the plastic shell. The container may be opened by urging the plastic shell upwardly with sufficient force to break the seal between the barrier cup and the container. The container then may be resealed by merely urging the closure back over the open top of the container.

7 Claims, 3 Drawing Sheets

RESEALABLE CLOSURE FOR CONTAINERS

BACKGROUND OF THE INVENTION

1. Field of the Invention

The present invention relates to a hermetically sealed barrier closure for a container that can provide a liquid-tight reseal after the hermetic seal is broken.

2. Description of Related Art

Tubes and containers include an open top having a closure that can be removed or opened to access the interior of the container.

Some closures comprise an elastomeric stopper that can be urged into the open top of the container to provide a liquid-tight seal. The stopper can be removed to access the interior of the container and then can be replaced in the opening to reseal the container. The stopper provides a liquid-tight seal both before the initial opening of the container and during any reclosure of the container. However, stoppers do not provide a hermetic seal which is necessary in some instances to ensure sterility.

Other closures include structure for threaded or snap-fit engagement with the top of the container. These closures are convenient for periodically accessing the contents of the container, but may not provide an adequate liquid-tight seal, and do not provide a hermetic seal.

Some containers have a barrier bonded or hermetically sealed over the open top of the container. The barrier is substantially impermeable to most gases and liquids, and hence, the contents of the container can be hermetically sealed prior to use. However, these barriers cannot reseal the open top to the container after the initial opening. Thus, an entirely separate closure is required to reclose the container after the initial use.

SUMMARY OF THE INVENTION

The present invention is directed to a resealable barrier closure for a container. The container includes a closed bottom, an open top and a continuous side wall extending therebetween. An annular snap ring or other engagement structure may project outwardly from the side wall at a location spaced slightly from the open top of the container.

The resealable barrier closure includes a shell with a top wall that generally conforms to the shape of the open top of the container. The top wall of the shell may include an aperture extending therethrough for accommodating a needle cannula that may be used to deposit material into the container or to withdraw material from the container.

The shell of the resealable barrier closure further includes an outer skirt that is dimensioned to telescope over the open top of the container. Inner circumferential portions of the outer skirt may include a snap ring or other engagement structure for resealable engagement with the snap ring or other such engagement structure on the container.

The shell further includes an inner skirt projecting from the top wall and spaced circumferentially inwardly from the outer skirt. The inner skirt preferably defines an outside diameter approximately equal to the inside diameter of the opening to the container. Thus, the shell can be tightly fitted onto the open top of the container, with the inner skirt engaged against the inner surface of the container adjacent the open top and with the outer skirt engaged with the outer surface of the container adjacent the open top.

The resealable barrier closure further includes an elastomeric diaphragm that is resiliently engaged within the inner skirt of the shell. Thus, the elastomeric diaphragm biases the inner skirt outwardly and helps to achieve a liquid tight seal between the inner skirt and the inner surface of the container adjacent the open top.

The resealable barrier closure further includes a barrier for sealing the container. The barrier may be formed substantially into the shape of a cup, and thus may have a bottom wall and a side wall extending upwardly from the bottom wall. The bottom wall extends continuously across the bottom end of the inner skirt and across the bottom surface of the elastomeric diaphragm. The side wall of the barrier surrounds the inner skirt of the shell. The barrier may further include a top flange that extends outwardly from the side wall. The top flange lies adjacent the bottom surface of the top wall of the shell and extends substantially continuously between the inner and outer skirts.

The resealable barrier closure is mounted to the open top of the container such that the outer skirt telescopes around the open top and such that the inner skirt and portions of the barrier surrounding the inner skirt telescope into the open top. The closure is urged downwardly onto the container until the snap ring on the outer skirt engages the snap ring on the container. This complete seating of the closure with the container achieves intimate contact between the outer surface of the side wall of the barrier and the inner surface of the side wall of the container. Additionally, the top flange of the barrier achieves intimate contact with both the top edge of the container and the bottom surface of the top wall of the shell. This assembly may be heated so that the barrier is bonded to adjacent regions of the shell and the container to provide a hermetic seal.

The container may be opened by urging the closure upwardly relative to the top of the container. Forces on the closure cause the snap rings to disengage and cause the barrier to separate from the container. The container may be resealed by urging the closure downwardly until the snap ring of the shell engages the snap ring on the container. This snapped engagement ensures that the inner skirt is fully telescoped within the open top of the container. Resilient forces exerted by the elastomeric diaphragm urge the inner skirt and adjacent portions of the barrier seal into fluid-tight engagement with the container.

DETAILED DESCRIPTION

Figure 1:
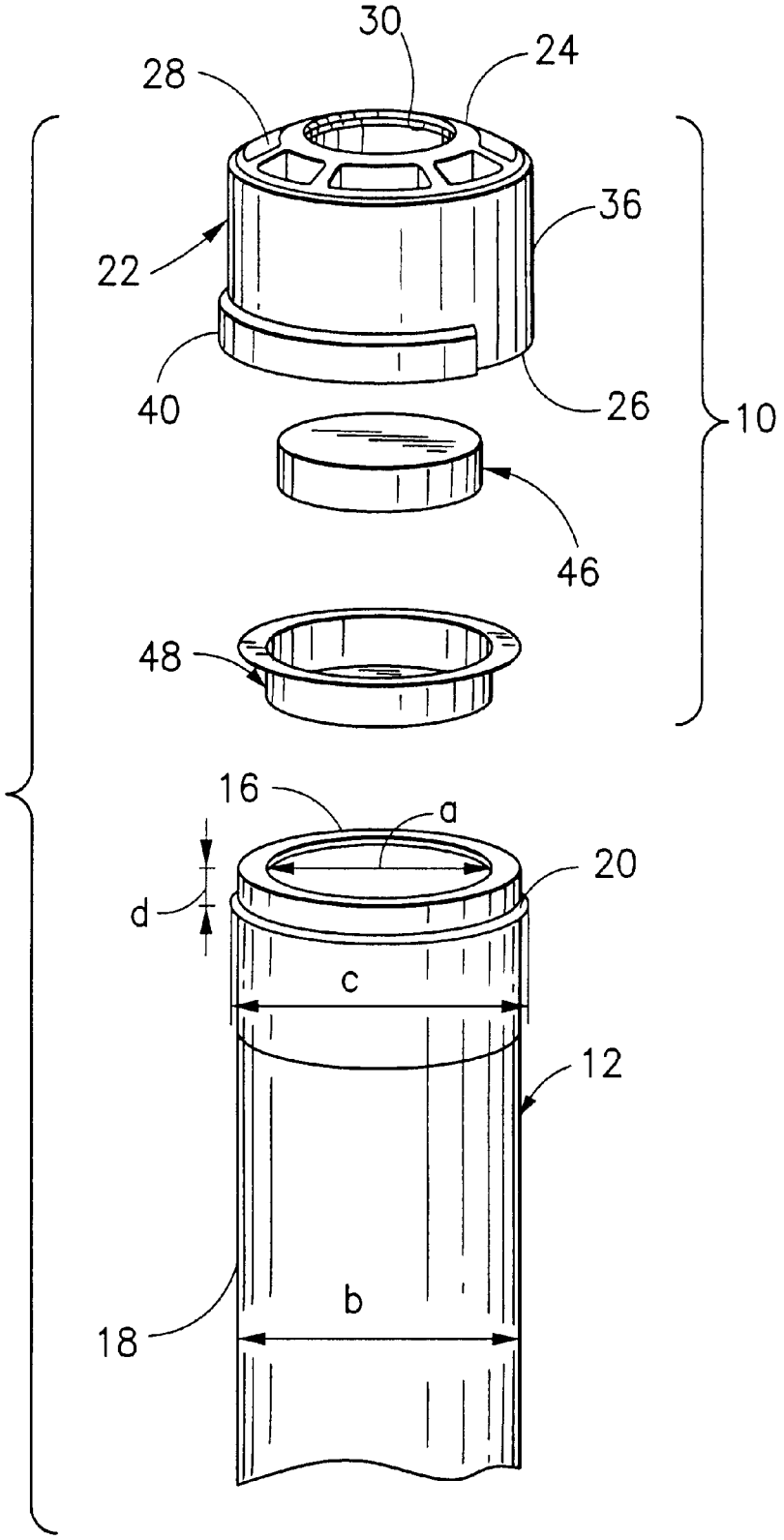
FIG. 1 is an exploded perspective view of the container and resealable barrier closure of the present invention.
Figure 6:
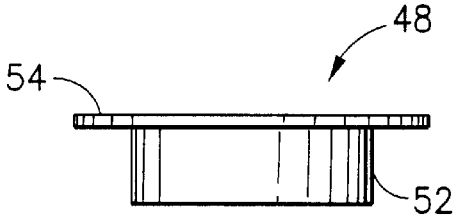
FIG. 6 is a side elevational view of the barrier cup.
Figure 7:
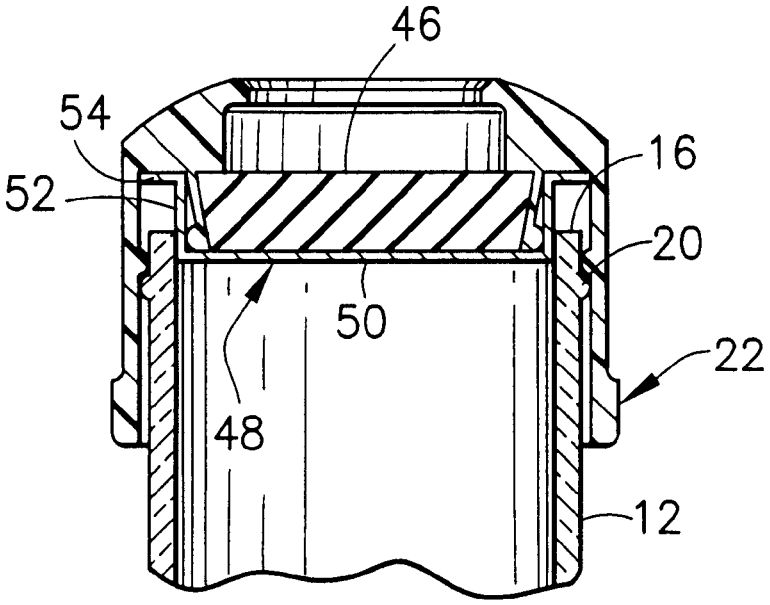
FIG. 7 is a longitudinal cross-sectional view of the closure in the first mounted condition on the container.

Referring to the drawings in which the like reference characters refer to like parts throughout the several views thereof, FIGS. 1, 6 and 7 illustrate a closure assembly 10 that is used for hermetically sealing and subsequently resealing a container 12. Container 12 includes a closed bottom, an open top 16 and a cylindrical side wall 18 extending therebetween. Side wall 18 of container 12 defines an inside diameter "a" and an outside diameter "b" as shown in FIG. 1. The outer surface of side wall 18 in proximity to open top end 16 is characterized by an outwardly extending annular snap ring 20 which defines an outside diameter "c". Snap ring 20 includes an upwardly and outwardly facing ramp surface and a downwardly facing lock surface aligned in a radial plane of container 12 that is spaced from top 16 of container 12 by a distance "d".

Figure 2:
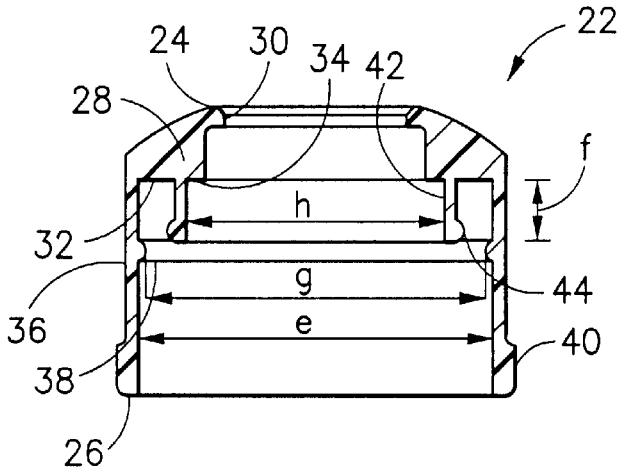
FIG. 2 is a longitudinal cross-sectional view of the plastic shell of the closure shown in FIG. 1.

Closure assembly 10 includes a shell 22 as shown in FIG. 2. Shell 22 is generally of a stepped cylindrical configuration and includes a top end 24 and a bottom end 26. Top end 24 is characterized by an annular top wall 28 having a substantially circular aperture 30 extending centrally therethrough. Top wall 28 further includes an annular downwardly facing barrier support surface 32 and an annular downwardly facing diaphragm support surface 34 which is spaced inwardly from barrier support face 32.

Shell 22 further includes a generally cylindrical outer skirt 36 extending downwardly from top wall 28 to bottom end 26 of shell 22. Outer skirt 26 defines an inside diameter "d" which is approximately equal to outside diameter "e" of snap ring 20 on container 12. The inner circumferential surface of outer skirt 36 is characterized by an annular inwardly extending snap ring 38 spaced downwardly from barrier support wall 32 by a distance "f" approximately equal to or slightly greater than distance "d" between top end 16 of container 12 and the bottom face of snap ring 20. Inwardly extending snap ring 38 of shell 22 defines an inside diameter "g" which is approximately equal to outside diameter "b" of portions of container 12 spaced from snap ring 20.

Outer skirt 36 farther includes an outwardly extending holder interference rib 40 substantially adjacent bottom end 26 of shell 22. Holder interference rib 40 defines an outside diameter approximately equal to or slightly greater than the inside diameter of a container holder with which container 12 and closure 10 may be employed. These dimensions enable an interference fit with the holder for preventing push back of container 12 in response to forces generated by blood flowing into container 12.

Shell 22 further includes substantially cylindrical inner skirt 42 which is concentric with outer skirt 36 and spaced inwardly therefrom. Inner skirt 42 extends a short axial distance from a location on top wall 28 between barrier support surface 32 and diaphragm support surface 34. Outer circumferential portions of inner skirt 42 furthest from top wall 28 include an annular bead 44 which defines an outside diameter approximately equal to or slightly greater than inside diameter "a" of container 12. Inner circumferential portions of skirt 42 define a uniform inside diameter "h".

Figure 3:
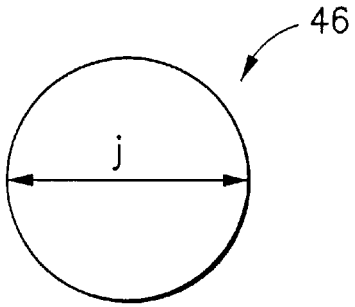
FIG. 3 is a top plan view of the elastomeric diaphragm of the closure.
Figure 4:
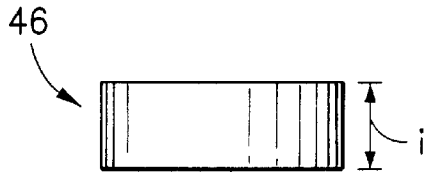
FIG. 4 is a side elevational view of the elastomeric diaphragm.

Closure assembly 10 further includes a short cylindrical elastomeric diaphragm 46 as shown most clearly in FIG. 3 and 4. Diaphragm 46 is unitarily molded from a thermoplastic elastomer or thermoset resin and defines an axial length approximately equal to the axial length of inner skirt 42. Additionally, diaphragm 46 further defines a diameter "j " which is approximately equal to or slightly greater than inside diameter "h" of inner skirt 42 of shell 22. With these relative dimensions, diaphragm 46 can be slidably inserted within inner skirt 42 such that outer circumferential regions of one circular face of diaphragm 46 are seated against diaphragm support seat 34 of shell 22. The opposed circular face of diaphragm 46 will be substantially coplanar with the lower end of inner skirt 42. With these relative dimensions, diaphragm 46 provides a fluid tight seal against diaphragm support surface 34 and against inner skirt 42. Additionally, diaphragm 46 exerts an outward biasing force against inner skirt 42 that will generate a minor outward deflection of inner skirt 42.

Figure 5:
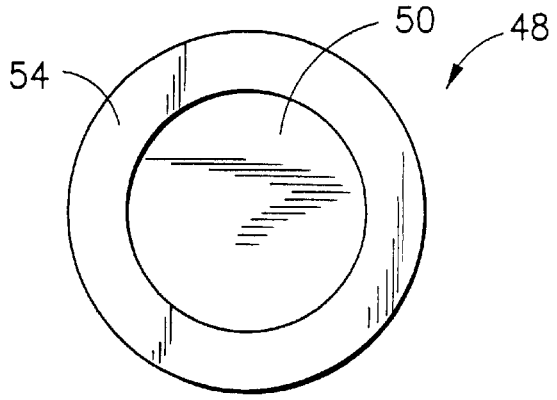
FIG. 5 is a top plan view of the barrier cup of the closure shown in FIG. 1.

Closure assembly 10 further includes a barrier cup 48 that is unitarily formed from a liquid and gas impermeable material that will provide a vapor barrier. For example, barrier cup 48 may be formed from a metallic foil, or from a metallic foil laminated on one or both sides with a plastic material. Alternatively, barrier cup 48 may be formed from a metalized polyester, a ceramic coated polyester, polyester-polyoefilin, PVDC or other material that provides a vapor barrier. The barrier cup also may be coated on one or both sides with an adhesive to provide structural integrity with other parts of closure 10 and to achieve a hermetic seal with container 12, as explained herein. Barrier cup 48, as shown in FIGS. 5 and 6, is formed to define a substantially circular bottom wall 50 having an outside diameter approximately equal to inside diameter "a" of container 12. Barrier cup 48 further includes a short cylindrical side wall 52 extending upwardly from bottom wall 50 a distance approximately equal to the axial length of inner skirt 42 of shell 22. Side wall 52 defines an inside diameter approximately equal to the outside diameter of inner skirt 42 at locations between bead 44 and barrier support surface 32. Barrier cup 48 further includes a flange 54 extending outwardly from locations on side wall 52 furthest from bottom wall 50. Flange 54 defines a radial dimension approximately equal to the radial dimension of barrier support surface 32 on shell 22.

Closure 10 is assembled by urging elastomeric diaphragm 46 into inner skirt 42, such that outer circumferential regions of one circular face of diaphragm 46 seat against diaphragm support surface 34 of shell 22. Additionally, the outer cylindrical surface of diaphragm 46 will be biased against the inner cylindrical surface of inner skirt 42. In this mounted condition, the lower circular face of diaphragm 46 will substantially align with the lower end of inner skirt 42. Assembly of closure 10 proceeds by urging barrier cup 48 over inner skirt 42 such that the lower end of inner skirt 42 abuts bottom wall 50 of barrier cup 48, and such that flange 54 of barrier cup 48 seats against barrier support surface 32 of shell 22.

Figure 8:
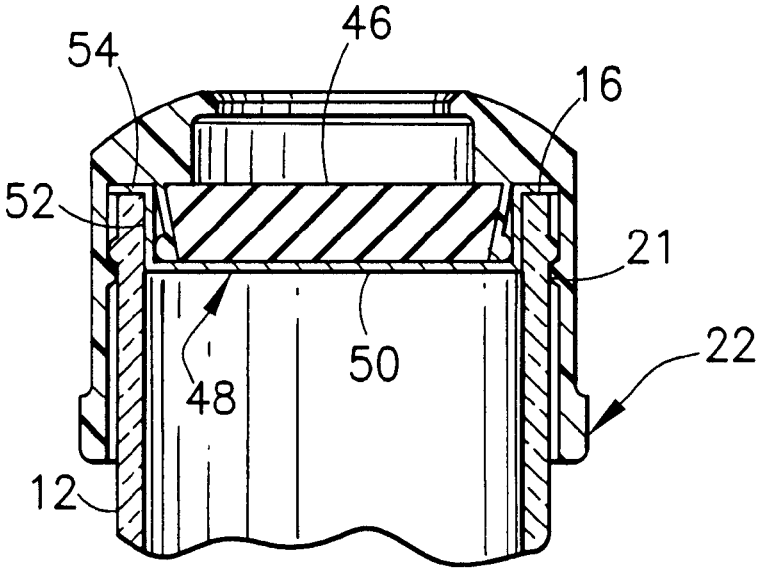
FIG. 8 is a cross-sectional view similar to FIG. 7, but showing the closure fully mounted on and sealed to the container.

Outer skirt 36 of shell 22 then is telescoped over portions of side wall 18 of container 12 adjacent open top 16. Snap ring 38 of outer skirt 36 will engage snap ring 20 of container 12 as shown in FIG. 7. However, snap ring 20 of container 12 includes an upwardly and outwardly facing ramp surface that facilitates outward deflection of outer skirt 42 sufficient for snap ring 38 to pass below snap ring 20 of container 12. Outer skirt 42 then will resiliently return to an undeformed condition, with snap ring 38 thereof engaged below snap ring 20 on container 12 as shown in FIG. 8. In this condition, flange 54 of barrier cup 48 will be urged tightly between top end 16 of container 12 and barrier support surface 32 of shell 22. Additionally, in this fully mounted condition, side wall 52 of barrier cup 48 will be squeezed between annular bead 44 of inner skirt 42 and the inner circumferential surface of side wall 18 on container 12. The assembly of closure 10 and container 12 then may be subjected to heat for adhering or bonding barrier cup 48 to both container 12 and shell 22 for providing a hermetic seal of the inside of container 12.

The assembly of closure 10 and container 12 may be used in a conventional manner by urging a needle cannula through aperture 30 in shell 20 and piercing the needle cannula through both elastomeric diaphragm 46 and bottom wall 50 of barrier cup 48. The needle cannula may be used to deposit material, such as blood, into container 12 or to withdraw material from container 12. Upon withdrawal of the needle cannula from closure assembly 10 and container 12, elastomeric diaphragm 46 will reseal the puncture site to continue to provide a liquid tight seal of container 12. However, the puncture of barrier cup 48 will have broken the hermetic seal.

In situations where closure assembly 10 and container 12 are used for depositing a sample of material, such as blood, container 12 with the blood or other material therein my be sent to a laboratory for analysis. Closure 10 may be removed from container 12 merely by exerting an upward force on shell 22 relative to container 12. The upward force will cause annular lock bead 38 of outer skirt 36 to ride over annular lock bead 20 on container 12, while simultaneously breaking the seal between barrier cup 48 and container 12. Upon complete removal of closure 10 from container 12, a probe or other laboratory instrument may be employed to access material in container 12 and to remove a portion of that material. Any remaining materials in container 12 can be resealed merely by urging closure 10 back over top 16 of container 12. More particularly, the above-described dimensions of annular bead 44 on inner skirt 42 and the biasing forces exerted by elastomeric diaphragm 46 on inner skirt 42 will achieve a fluid tight seal of container 12. Additionally, snap ring 38 of shell 22 can be urged below snap ring 20 of container 12 for releasably locking closure 10 in its sealed engagement with container 12.

What is claimed is:

1. A closure for a container having a side wall and an open top, said closure comprising:

a shell having a top wall dimensioned for disposition adjacent the open top of a container, an outer skirt depending downwardly from said top wall and dimensioned for telescoped engagement around the side wall of a container, an inner skirt depending downwardly from said top wall and spaced inwardly from said outer skirt, said inner skirt being dimensioned for telescope engagement in the open top of a container, a barrier support surface in said top wall of said shell between said inner skirt and said outer skirt, apertures in said top wall of said shell extending therethrough at locations spaced inwardly from said inner skirt, and a disphragm support surface spaced inwardly from said inner skirt and extending between said inner skirt and said aperture;

an elastomeric diaphragm surrounded by and engaged with said inner skirt of said shell, wherein portions of said elastomeric diaphragm being seated tightly against said diaphragm support surface of said top wall of said shell; and a barrier cup formed from a vapor barrier material, said barrier cup having a bottom wall extending across portions of said inner skirt remote from said top wall of said shell, a side wall extending from said bottom wall and disposed around said inner skirt, and a top flange extending outwardly from said side wall of said barrier cup and disposed adjacent said top wall of said shell, said barrier cup being hermetically sealable between a container and said shell, whereby said barrier support surface is disposed in face-to-face engagement with said top flange of said barrier cup.

2. The closure of claim 1, wherein said top wall of said shell includes an aperture extending therethrough for providing access to said elastomeric diaphragm.

3. The closure of claim 1, wherein said container includes an outwardly extending annular snap bead on said side wall in proximity to said open top, said outer skirt of said shell of said closure including an inwardly extending annular snap bead disposed and dimensioned for resealable engagement with said snap bead of said container.

4. The closure of claim 1, wherein said inner skirt includes an outwardly extending annular rim, said annular rim being dimensioned for resilient engagement against inner surface regions of said side wall of said container.

5. The closure of claim 1, wherein said barrier cup comprises a foil layer having at least one plastic layer laminated thereto.

6. The closure of claim 5, wherein said barrier cup has heat sensitive adhesive applied to opposed faces thereof for secure adhesion to both said container and said shell.

7. A resealable container comprising:

a plastic container having a substantially cylindrical side wall and an open top, portions of said side wall in proximity to said open top having an outwardly extending annular snap bead thereon;

a shell having an annular top wall disposed adjacent said open top of said container, said top wall having an aperture extending therethrough, an outer skirt extending downwardly from said top wall and telescoped over portions of said side wall of said container adjacent said open top, said outer skirt including an inwardly extending annular snap bead releasably locked with said annular snap bead of said container, and an inner skirt depending downwardly from said top wall of said shell and telescoped into portions of said side wall of said container adjacent said open top, whereby said top wall of said shell extends inwardly from said inner skirt;

an elastomeric diaphragm resiliently engaged within said inner skirt, whereby said diaphragm is seated against portions of said top wall inwardly from said inner skirt; and a barrier cup having a bottom wall extending continuously across said diaphragm and across portions of said inner skirt remote from said top wall of said shell, an annular side wall extending upwardly from said bottom wall and disposed between said side wall of said container and said inner skirt, a top flange extending outwardly from said side wall and disposed between said top of said container and said top wall of said shell and extending continuously between said inner and out skirts of said shell, said barrier cup is unitarily formed from a moisture impermeable material comprising a layer of metallic foil and at least one plastic layer laminated to said foil, and at least one layer of adhesive applied to said moisture impermeable material to provide a hermetic seal between barrier said cup and said container and between said barrier cup and said shell, whereby said barrier cup is separable from said hermetical seal from said container for accessing interior portions of said container whereby said diaphragm and said inner skirt and said barrier cup are dimensioned for resiliently biased engagement against said side wall of said container for providing a liquid-tight seal with said container when said barrier cup is separated from said hermetical seal.

* * * * *